US009816056B2

(12) United States Patent
Frankenbach et al.

(10) Patent No.: US 9,816,056 B2
(45) Date of Patent: Nov. 14, 2017

(54) ASSOCIATING A SCENT WITH A LAUNDRY ARTICLE

(71) Applicant: The Procter & Gamble Company, Cincinnati, OH (US)

(72) Inventors: Gayle Marie Frankenbach, Cincinnati, OH (US); Helen Frances O'Connor, Cincinnati, OH (US); Michael David Sanders, Cincinnati, OH (US); Judith Ann Hollingshead, Batavia, OH (US); David Anthony Bailey, Amberly Village, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 8 days.

(21) Appl. No.: 14/886,756

(22) Filed: Oct. 19, 2015

(65) Prior Publication Data

US 2017/0107458 A1 Apr. 20, 2017

(51) Int. Cl.

| | |
|---|---|
| ***C11D 3/50*** | (2006.01) |
| ***C11D 1/00*** | (2006.01) |
| ***C11D 17/06*** | (2006.01) |

(52) U.S. Cl.

CPC ..... *C11D 3/50* (2013.01); *C11D 1/00* (2013.01); *C11D 3/505* (2013.01); *C11D 17/06* (2013.01)

(58) Field of Classification Search

CPC ..... C11D 3/505; C11D 17/041

See application file for complete search history.

(56) References Cited

U.S. PATENT DOCUMENTS

| | | | | |
|---|---|---|---|---|
| 8,476,219 | B2 | 7/2013 | Aouad | |
| 9,347,022 | B1 | 5/2016 | Frentzel et al. | |
| 9,453,188 | B2 | 9/2016 | Brown et al. | |
| 2003/0008085 | A1* | 1/2003 | Davenet | D06F 95/006 428/35.4 |
| 2003/0104969 | A1 | 6/2003 | Welch et al. | |
| 2003/0166489 | A1 | 9/2003 | Van Asten et al. | |
| 2008/0014393 | A1 | 1/2008 | Denome et al. | |
| 2012/0046359 | A1* | 2/2012 | Bedoukian | A01N 35/02 514/530 |
| 2016/0121286 | A1 | 5/2016 | Sodd et al. | |
| 2016/0122693 | A1 | 5/2016 | Sodd et al. | |
| 2016/0368169 | A1 | 12/2016 | Huddleston et al. | |
| 2016/0369211 | A1 | 12/2016 | Dykstra et al. | |
| 2017/0105560 | A1 | 4/2017 | Frankenbach | |
| 2017/0106112 | A1 | 4/2017 | Frankenbach et al. | |

(Continued)

FOREIGN PATENT DOCUMENTS

| | | | |
|---|---|---|---|
| EP | 1026231 | * | 8/2000 |
| EP | 1 574 561 A1 | | 9/2005 |

OTHER PUBLICATIONS

International Search Report for International Application Serial No. PCT/US2016/055276, dated Nov. 28, 2016, 12 pages.

*Primary Examiner* — John Hardee

(74) *Attorney, Agent, or Firm* — Gary J. Foose

(57) ABSTRACT

A process for associating a scent with a laundry article including the steps of: providing a fluid pervious substrate carrying a perfume on, within, or at least partially enclosed by the substrate; placing the substrate in proximity to a partially saturated laundry article within a container or pile; transferring the laundry article and the substrate from the container or the pile into a washing machine; and washing the laundry article together with the substrate.

14 Claims, 5 Drawing Sheets

(56) References Cited

U.S. PATENT DOCUMENTS

| | | | |
|---|---|---|---|
| 2017/0106114 | A1 | 4/2017 | Frankenbach |
| 2017/0107450 | A1 | 4/2017 | Frankenbach et al. |
| 2017/0107455 | A1 | 4/2017 | Frankenbach et al. |
| 2017/0107462 | A1 | 4/2017 | Frankenbach |

* cited by examiner

ASSOCIATING A SCENT WITH A LAUNDRY ARTICLE

FIELD OF THE INVENTION

Associating a scent with a laundry article.

BACKGROUND OF THE INVENTION

Managing dirty laundry in an urban dwelling can be particularly challenging. The sweat and grime often associated with living in a crowded city can accumulate on clothing. As more dirty laundry accumulates and ages through the week, the resulting stench can be quite intruding on the residents of the dwelling. The vast majority of urban dwellings are small compact spaces in which various spaces have multiple functions. For instance the living room can also function as a bedroom. Often, closet space is limited or even non-existent. Bathroom space is often limited and may suffer from inadequate ventilation. The bedrooms in urban dwellings are often small and function as a room in which to sleep and maintain the flux of articles, including dirty laundry, that move into an out of the resident's use. So, dirty laundry is often stored in a room in which the residents, and perhaps guests, spend a considerable amount of time or in a room that is poorly ventilated.

The odors associated with dirty laundry can be repulsive to persons proximal the dirty laundry. Thus, dirty laundry stored in a typical urban dwelling can impinge upon the resident's and her visitor's quality of life.

Storing the dirty laundry in a clothing hamper having a lid does not completely ameliorate the problem. The simple act of opening and closing the hamper can release putrid odors into the dwelling.

The problems described above are not limited to urban dwellings. Dwellings such as dormitories, apartments, barracks, and camps can suffer from the same or similar problems.

In view of the of the problem associated with managing dirty laundry in a crowded living space, there is a continuing unaddressed need for products and processes for associating scent with laundry articles.

SUMMARY OF THE INVENTION

A process for associating a scent with a laundry article comprising the steps of: providing a fluid pervious substrate carrying a perfume on, within, or at least partially enclosed by the substrate; placing the substrate in proximity to a partially saturated laundry article within a container or pile; transferring the laundry article and the substrate from the container or the pile into a washing machine; and washing the laundry article together with the substrate.

DETAILED DESCRIPTION OF THE INVENTION

Figure 1:
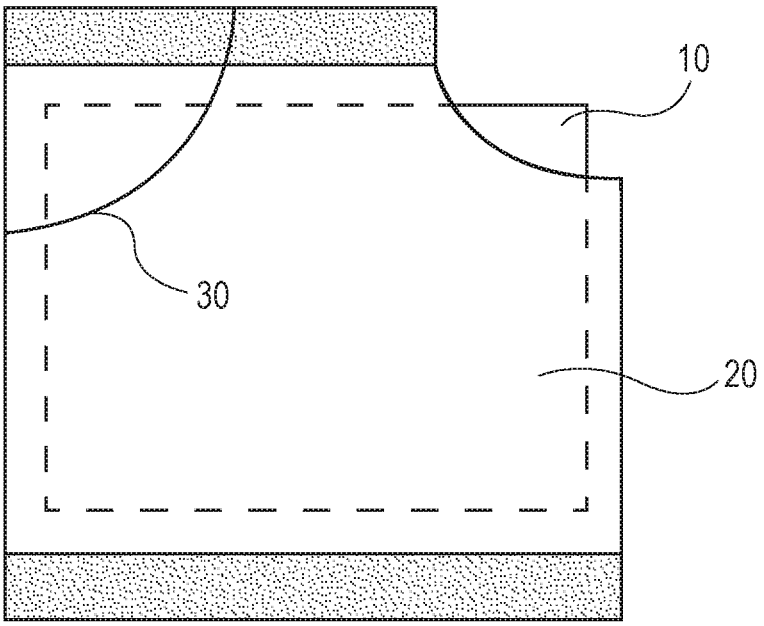
FIG. 1 is a sleeve containing a substrate.

A scent can be associated with laundry articles as described herein. As dirty laundry articles are accumulated in a pile or container over the course of several days, the consumer at some point in time can provide a fluid pervious substrate carrying a perfume on, within, or at least partially enclosed by the substrate. The substrate can be placed in proximity to a partially saturated (i.e. not soaked) laundry article within a container or pile. For clarity, the container, as described herein, can be a non-water dispensing container. The laundry article and the substrate can be transferred from the container or pile into a washing machine. Optionally, a detergent composition can be dispensed into the washing machine. The laundry article and the substrate can be washed together. The scent can be provided to the laundry article prior to washing. The scent can be further provided during the wash cycle.

The process is simple for a consumer to employ. For instance, before or upon a container containing dirty laundry or a pile of dirty laundry becoming unacceptably odiferous, the consumer can simply place the substrate in the container or below or in or on top of the pile of laundry. Over time the perfume carried on the substrate can be released, thereby improving the scent experience of the consumer. When the consumer is ready to wash the dirty partially saturated laundry article, the consumer can simply transfer the dirty partially saturated laundry article and the fluid pervious substrate carrying perfume into the washing machine. Since the substrate carrying the perfume is fluid pervious, it launders much like a garment and interferes little, if at all, with the washing process. Thus, the consumer does not need to hunt through the multitude of dirty laundry articles to recover the scented fluid pervious substrate prior to washing the dirty laundry articles. If there is perfume associated with the substrate remaining at the time of washing, the perfumed substrate may even deliver perfume to the laundry article or release perfume into the air of the room in which laundering is conducted during the wash cycle.

Once the washing cycle is over, the consumer can transfer all or a portion of the load, including the fluid pervious substrate, which may or may not carry perfume at this juncture, to a clothing dryer. Again, the consumer does not need to hunt through the load of clean wet laundry to recover the fluid pervious substrate since the fluid pervious substrate behaves much like a garment in the dryer. Once the load of laundry, including the fluid pervious substrate, is dry to the degree desired by the consumer, the load of laundry can be removed from the dryer and folded. As the consumer folds the clean laundry, the fluid pervious substrate will be discovered and recovered by the consumer and the consumer can dispose of the fluid pervious substrate appropriately. This process is familiar to consumers who have experience using dryer sheets for fabric softening, scenting, and or static control. If a dryer is not employed by the consumer, as the consumer hangs individual laundry articles for drying, the consumer will discover and recover the fluid pervious substrate and can dispose of appropriately.

The elegance of the above described process is that it requires little change to the consumer's behavior. The consumer only needs to make a decision to use a product designed for carrying out the method by choosing to provide the fluid pervious substrate carrying perfume and placing the substrate in her laundry storage container or laundry pile. After that, the consumer can behave as she normally would even if she were not using the process described herein and the process works. After completing the steps of the process, the consumer can rediscover that she used the method when she sees the used substrate and simply disposes of the consumed substrate appropriately. The benefit to the consumer is essentially accrued automatically and effortlessly, and benefits all of the persons that occupy a compact living space.

As described herein, the substrate can be placed in proximity to the partially saturated laundry article within a container. The container can be selected from the group consisting of a laundry hamper, a laundry basket, a laundry bag, a duffle bag, a gym bag, a suitcase, and a drawer. The substrate can be placed in one of the aforesaid non-water dispensing containers while the container is empty, after a few laundry articles have been placed in the container, or after a particularly odiferous laundry article is placed in the container, or after the container is full and the consumer recognizes that the contents have an undesirable odor and that it may be a few days before he or she has time to do the laundry.

The laundry article is described herein as being partially saturated when the substrate is placed in proximity to such article. By partially saturated, it is meant that when the laundry article is elevated above a surface, liquid does not drip freely from the laundry article. A partially saturated laundry article has the capacity to absorb or adsorb additional water beyond the amount absorbed or held by the article in a partially saturated condition. The article may be partially saturated by retaining sweat or other vapors imparted to the structure of the article during wear. The article may be partially saturated due to the hygroscopic nature of the fibers and webs of material from which articles are made. For instance, cotton fibers absorb and adsorb appreciable amounts of water in a humid conditions and or wet conditions.

Unlike processes for associating scent to laundry articles in which substances are delivered to the articles in the wash, the process described herein involves transferring both the laundry article and the substrate from the non-water dispensing container or pile into a washing machine. That is, both the laundry article and the substrate are transferred together from the container or pile into the washing machine.

Package

The fluid pervious substrate 10 can be packaged within a hermetically sealed sleeve 20, as shown in FIG. 1. The process can further comprise the step opening the sleeve 20 and removing the substrate 10 from the sleeve 20. Then the substrate 10 can be placed in proximity to the partially saturated laundry article within a container or pile. The container can be a non-water dispensing container. The sleeve 20 can be formed of a plastic film material. Packaging the substrate 10 in a hermetically sealed sleeve 20 can be practical for reducing the amount of perfume lost from the substrate 10 via evaporation, which thereby leave more perfume available for providing the scent to the laundry article. The sleeve 20 can have a line of weakness 30. The line of weakness 30 can be a preferential line of weakness that can be torn or ripped to open the sleeve 20 to permit the consumer to retrieve the substrate 10. The substrate 10 can be individually packaged within a hermetically sealed sleeve 20 or packaged with a plurality of substrates 10 within a single sleeve 20. A fluid pervious pouch comprising the substrate 10 can packaged in a hermetically sealed sleeve 20 likewise. If a pouch comprises the fluid pervious substrate 10, the pouch can be packaged within a hermetically sealed sleeve 20 in the same manner.

Substrate

A fluid pervious substrate 10 is a porous substrate. A fluid pervious substrate is pervious to the flow of water. A fluid pervious substrate can have a cross plane saturated hydraulic conductivity greater than about $1\times10^{-4}$ cm/s. A fluid pervious substrate can have an apparent opening size according to ASTM D4751-12 greater than, optionally greater than or equal to 0.075 mm.

The substrate 10 can be water insoluble. The substrate 10 can be a fibrous web. For instance the substrate can be a fibrous web of the type commonly employed in dryer sheet products, including the substrate presently marketed as a dryer sheet under the BOUNCE brand, by The Procter & Gamble Company, Cincinnati, Ohio. The substrate 10 can be a fibrous nonwoven web. Fibrous webs such as those used in dryer sheets are thought to be durable enough to pass through both the wash and the drying cycle without the web disintegrating into multiple pieces.

The substrate 10 can be a polyester nonwoven fabric prepared from a polyester fiber having a denier of from about 2 to about 6. The substrate 10 can have a basis weight between about 1 gsm to about 100 gsm (gsm meaning grams per square meter throughout this disclosure). The substrate 10 can have a basis weight between about 10 gsm to about 50 gsm. The substrate 10 can have a thickness between about 0.01 mm and about 20 mm. The substrate 10 can have a thickness between about 0.05 mm and about 2 mm. The substrate 10 can be a spun bonded web. The substrate 10 can be a web having a structure of individual fibers or threads which are interlaid, but not in a repeating pattern as in a woven or knitted fabric. The substrate can be a nonwoven web that is hydroentangled, spun laced, or bonded carded. The substrate can comprise polymeric fibers. Fibers that are polyolefinic can be suitable. Polypropylene and polyethylene fibers can also be suitable as either mono-component fibers or bicomponent fibers. Other polymers such as polyvinyl alcohol, polyethylene, polyethylene terephthalate, and nylon can be suitable.

The substrate 10 can be a material that is compliant and soft feeling. A suitable substrate 10 can be manufactured from a wide range of materials such as polymeric materials, formed thermoplastic films, apertured plastic films, porous films, aperture formed films, reticulated foams, woven and non-woven synthetic fibers (e.g., polyester or polypropylene fibers) or from a combination of natural and synthetic fibers.

Optionally, the substrate 10 can be formed into a pouch that at least partially encloses particles that carry perfume.

The substrate 10 can be a nonwoven material available from FITESA, Washougal, Wash., United States of America, style 083YLJO09P, item description W4566, basis weight 27.8125 gsm. The substrate 10 can have a basis weight between about 20 gsm and about 40 gsm. The substrate 10 can have a thickness between about 0.05 mm and about 2 mm.

The substrate 10 can carry perfume on, within, or at least partially enclosed by the substrate For example, the substrate 10 can be at least partially coated with a solid matrix carrying the perfume. The solid matrix carrier can be hot melt material that comprises the perfume. Optionally, the substrate 10 can carry a solid matrix that in turn carries perfume within the matrix and the matrix is positioned within the interstitial spaces between fibers of the substrate 10. The substrate 10 can carry a solid matrix on an external surface of the substrate 10 and in the substrate 10 in the interstitial spaces between fibers comprising the substrate 10.

The substrate 10 can have an apparent opening size according to ASTM D4751-12 smaller than about 1000 μm. The substrate 10 can have an apparent opening size according to ASTM D4751-12 from about 50 μm to about 1000 μm. Such a substrate 10 can have a pleasant hand to the consumer. And, if the substrate 10 is used in an embodiment in which particles are employed, such substrate 10 can help reduce the potential that the consumer's hand will come into contact with the particles during use. The substrate 10 can have a basis weight between about 1 gsm to about 100 gsm. Having such a basis weight can also help reduce the potential for the consumer to have contact with particles, if employed, and can provide for enough material to carry the desired amount of perfume.

The substrate 10 can be water insoluble. A substrate 10 is considered water insoluble if such substrate 10 can rest completely submerged in static deionized water for 24 hours at 20 degrees Celsius without losing more than 50% of its mass.

Carrier and Particles

The solid matrix carrier can be a carrier selected from the group consisting of water soluble organic alkali metal salt, water soluble inorganic alkaline earth metal salt, water soluble organic alkaline earth metal salt, water soluble carbohydrate, water soluble silicate, water soluble urea, starch, clay, water insoluble silicate, citric acid carboxymethyl cellulose, fatty acid, fatty alcohol, glyceryl diester of hydrogenated tallow, glycerol, polyethylene glycol, and combinations thereof. Alkali metal salts can be, for example, selected from the group consisting of salts of lithium, salts of sodium, and salts of potassium, and any combination thereof. Useful alkali metal salts can be, for example, selected from the group consisting of alkali metal fluorides, alkali metal chlorides, alkali metal bromides, alkali metal iodides, alkali metal sulfates, alkali metal bisulfates, alkali metal phosphates, alkali metal monohydrogen phosphates, alkali metal dihydrogen phosphates, alkali metal carbonates, alkali metal monohydrogen carbonates, alkali metal acetates, alkali metal citrates, alkali metal lactates, alkali metal pyruvates, alkali metal silicates, alkali metal ascorbates, and combinations thereof. Alkali metal salts can be selected from the group consisting of, sodium fluoride, sodium chloride, sodium bromide, sodium iodide, sodium sulfate, sodium bisulfate, sodium phosphate, sodium monohydrogen phosphate, sodium dihydrogen phosphate, sodium carbonate, sodium hydrogen carbonate, sodium acetate, sodium citrate, sodium lactate, sodium tartrate, sodium silicate, sodium ascorbate, potassium fluoride, potassium chloride, potassium bromide, potassium iodide, potassium sulfate, potassium bisulfate, potassium phosphate, potassium monohydrogen phosphate, potassium dihydrogen phosphate, potassium carbonate, potassium monohydrogen carbonate, potassium acetate, potassium citrate, potassium lactate, potassium tartrate, potassium silicate, potassium, ascorbate, and combinations thereof. Alkaline earth metal salts can be selected from the group consisting of salts of magnesium, salts of calcium, and the like, and combinations thereof. Alkaline earth metal salts can be selected from the group consisting of alkaline metal fluorides, alkaline metal chlorides, alkaline metal bromides, alkaline metal iodides, alkaline metal sulfates, alkaline metal bisulfates, alkaline metal phosphates, alkaline metal monohydrogen phosphates, alkaline metal dihydrogen phosphates, alkaline metal carbonates, alkaline metal monohydrogen carbonates, alkaline metal acetates, alkaline metal citrates, alkaline metal lactates, alkaline metal pyruvates, alkaline metal silicates, alkaline metal ascorbates, and combinations thereof. Alkaline earth metal salts can be selected from the group consisting of magnesium fluoride, magnesium chloride, magnesium bromide, magnesium iodide, magnesium sulfate, magnesium phosphate, magnesium monohydrogen phosphate, magnesium dihydrogen phosphate, magnesium carbonate, magnesium monohydrogen carbonate, magnesium acetate, magnesium citrate, magnesium lactate, magnesium tartrate, magnesium silicate, magnesium ascorbate, calcium fluoride, calcium chloride, calcium bromide, calcium iodide, calcium sulfate, calcium phosphate, calcium monohydrogen phosphate, calcium dihydrogen phosphate, calcium carbonate, calcium monohydrogen carbonate, calcium acetate, calcium citrate, calcium lactate, calcium tartrate, calcium silicate, calcium ascorbate, and combinations thereof. Inorganic salts, such as inorganic alkali metal salts and inorganic alkaline earth metal salts, do not contain carbon. Organic salts, such as organic alkali metal salts and organic alkaline earth metal salts, contain carbon. The organic salt can be an alkali metal salt or an alkaline earth metal salt of sorbic acid (i.e., asorbate). Sorbates can be selected from the group consisting of sodium sorbate, potassium sorbate, magnesium sorbate, calcium sorbate, and combinations thereof.

The solid matrix carrier can be or comprise a material selected from the group consisting of a water-soluble inorganic alkali metal salt, a water-soluble organic alkali metal salt, a water-soluble inorganic alkaline earth metal salt, a water-soluble organic alkaline earth metal salt, a water-soluble carbohydrate, a water-soluble silicate, a water-soluble urea, and combinations thereof. The carrier or water soluble-soluble carrier can be selected from the group consisting of sodium chloride, potassium chloride, calcium chloride, magnesium chloride, sodium sulfate, potassium sulfate, magnesium sulfate, sodium carbonate, potassium carbonate, sodium hydrogen carbonate, potassium hydrogen carbonate, sodium acetate, potassium acetate, sodium citrate, potassium citrate, sodium tartrate, potassium tartrate, potassium sodium tartrate, calcium lactate, water glass, sodium silicate, potassium silicate, dextrose, fructose, galactose, isoglucose, glucose, sucrose, raffinose, isomalt, xylitol, candy sugar, coarse sugar, and combinations thereof. In one embodiment, the solid matrix carrier or water-soluble carrier can be sodium chloride. In one embodiment, the solid matrix carrier or water-soluble solid matrix carrier can be table salt.

The solid matrix carrier can be or comprise a material selected from the group consisting of sodium bicarbonate, sodium sulfate, sodium carbonate, sodium formate, calcium formate, sodium chloride, sucrose, maltodextrin, corn syrup solids, corn starch, wheat starch, rice starch, potato starch, tapioca starch, clay, silicate, citric acid carboxymethyl cellulose, fatty acid, fatty alcohol, glyceryl diester of hydrogenated tallow, glycerol, and combinations thereof.

The solid matrix carrier can be selected from the group consisting of water soluble organic alkali metal salt, water soluble inorganic alkaline earth metal salt, water soluble organic alkaline earth metal salt, water soluble carbohydrate, water soluble silicate, water soluble urea, starch, clay, water insoluble silicate, citric acid, carboxymethyl cellulose, fatty acid, fatty alcohol, glyceryl diester of hydrogenated tallow, glycerol, polyvinyl alcohol, polyethylene glycol, and combinations thereof.

The solid matrix carrier can be selected from the group consisting of polyvinyl alcohol, modified polyvinyl alcohol, polyvinyl pyrrolidone, polyvinyl alcohol/polyvinyl pyrrolidone, polyvinyl alcohol/polyvinyl amine, partially hydrolyzed polyvinyl acetate, polyalkylene oxide, polyethylene glycol, acrylamide, acrylic acid, cellulose, alkyl cellulosics, methyl cellulose, ethyl cellulose, propyl cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides, starch, modified starch, gelatin, alginates, xyloglucans, hemicellulosic polysaccharides, xylan, glucuronoxylan, arabinoxylan, mannan, glucomannan, galactoglucomannan, natural gums, pectin, xanthan, carrageenan, locus bean, arabic, tragacanth, polyacrylates, sulfonated polyacrylates, water-soluble acrylate copolymers, alkylhydroxy cellulosics, methylcellulose, carboxymethylcellulose sodium, modified carboxy-methylcellulose, dextrin, ethylcellulose, propylcellulose, hydroxyethyl cellulose, hydroxypropyl methylcellulose, maltodextrin, polymethacrylates, polyvinyl alcohol copolymers, hydroxypropyl methyl cellulose, and mixtures thereof.

The solid matrix carrier can be polyethylene glycol having a weight average molecular weight between from about 2000 to about 13000.

The solid matrix carrier can be formed into water soluble particles that carry the perfume. The particles can be formed by a rotoforming process. The particles can be formed on a SANDVIK ROTOFORM 3000 having a 750 mm wide 10 m long belt. The rotoforming cylinder can have 2 mm diameter apertures set at 10 mm pitch in the cross machine direction and 9.35 mm pitch in the machine direction. The rotoforming cylinder be set at about 3 mm above the belt. The belt speed and rotational speed of the rotoforming cylinder can be set at 10 m/min. A melt of the precursor material for the particles can be pumped to the rotoforming cylinder at a rate of about 3.1 kg/min from a mixer. A plate and frame heat exchanger can be set to control the temperature to be about 50 degrees Celsius.

The solid matrix, or particles if employed, can comprise from about 40% by weight to about 99% by weight of the particles of the solid matrix carrier. The solid matrix carrier can be polyethylene glycol.

The solid matrix, or particles if employed, can comprise more than about 40% by weight polyethylene glycol having a weight average molecular weight from about 2000 to about 13000. Polyethylene glycol (PEG) has a relatively low cost, may be formed into many different shapes and sizes, minimizes unencapsulated perfume diffusion, and dissolves well in water. PEG comes in various weight average molecular weights. A suitable weight average molecular weight range of PEG includes from about 2,000 to about 13,000, from about 4,000 to about 12,000, alternatively from about 5,000 to about 11,000, alternatively from about 6,000 to about 10,000, alternatively from about 7,000 to about 9,000, alternatively combinations thereof. PEG is available from BASF, for example PLURIOL E 8000.

The solid matrix, or particles if employed, can comprise more than about 40% by weight of the particles of PEG. The solid matrix, or particles if employed, can comprise more than about 50% by weight of the solid matrix, or particles if employed, of PEG. The solid matrix, or particles if employed, can comprise more than about 60% by weight of the solid matrix, or particles if employed, of PEG. The solid matrix, or particles if employed, may comprise from about 65% to about 99% by weight of the solid matrix, or particles if employed of PEG. The solid matrix, or particles if employed, may comprise from about 40% to about 99% by weight of the solid matrix, or particles if employed, of PEG.

Alternatively, the solid matrix, or particles if employed, can comprise from about 40% to about 90%, alternatively from about 45% to about 75%, alternatively from about 50% to about 70%, alternatively combinations thereof and any whole percentages or ranges of whole percentages within any of the aforementioned ranges, of PEG by weight of the solid matrix, or particles if employed.

Depending on the application, the solid matrix, or particles if employed, can comprise from about 0.5% to about 5% by weight of the solid matrix, or particles if employed, of a balancing agent selected from the group consisting of glycerin, polypropylene glycol, isopropyl myristate, dipropylene glycol, 1,2-propanediol, and PEG having a weight average molecular weight less than 2,000, and mixtures thereof.

The solid matrix, or particles if employed, can comprise an antioxidant. The antioxidant can help to promote stability of the color and or odor of the solid matrix, or particles if employed, over time between production and use. The solid matrix, or particles if employed, can comprise between about 0.01% to about 1% by weight of the solid matrix, or particles if employed, antioxidant. The solid matrix, or particles if employed, can comprise between about 0.001% to about 2% by weight of the solid matrix, or particles if employed, antioxidant. The solid matrix, or particles if employed, can comprise between about 0.01% to about 0.1% by weight of the solid matrix, or particles if employed, antioxidant. The antioxidant can be butylated hydroxytoluene.

The particles may have a variety of shapes. The particles may be formed into different shapes include tablets, pills, spheres, and the like. A particle can have a shape selected from the group consisting of spherical, hemispherical, compressed hemispherical, lentil shaped, and oblong. Lentil shaped refers to the shape of a lentil bean. Compressed hemispherical refers to a shape corresponding to a hemisphere that is at least partially flattened such that the curvature of the curved surface is less, on average, than the curvature of a hemisphere having the same radius. A compressed hemispherical particle can have a ratio of height to maximum based dimension of from about 0.01 to about 0.4, alternatively from about 0.1 to about 0.4, alternatively from about 0.2 to about 0.3. Oblong shaped refers to a shape having a maximum dimension and a maximum secondary dimension orthogonal to the maximum dimension, wherein the ratio of maximum dimension to the maximum secondary dimension is greater than about 1.2. An oblong shape can have a ratio of maximum base dimension to maximum minor base dimension greater than about 1.5. An oblong shape can have a ratio of maximum base dimension to maximum minor base dimension greater than about 2. Oblong shaped particles can have a maximum base dimension from about 2 mm to about 6 mm, a maximum minor base dimension of from about 2 mm to about 6 mm.

Individual particles can have a mass from about 0.1 mg to about 5 g, alternatively from about 10 mg to about 1 g, alternatively from about 10 mg to about 500 mg, alternatively from about 10 mg to about 250 mg, alternatively from about 0.95 mg to about 125 mg, alternatively combinations thereof and any whole numbers or ranges of whole numbers of mg or grams within any of the aforementioned ranges. In a plurality of particles, individual particles can have a shape selected from the group consisting of spherical, hemispherical, compressed hemispherical, lentil shaped, and oblong.

An individual particle may have a volume from about 0.003 $cm^3$ to about 0.15 $cm^3$. The plurality of particles can be made up of particles having different size, shape, and/or mass.

Each of the particles can have a mass between about 0.1 mg to about 5 g. Particles can have a maximum dimension of less than about 20 mm. Particles can have a maximum dimension of less than about 10 mm. Particles having such a mass and maximum dimension are thought to be readily dissolvable in solutions such a wash solutions used in laundering clothing.

Perfume

The perfume can comprise one or both of unencapsulated perfume and encapsulated perfume. The perfume can be perfume provided by a perfume delivery technology, or a perfume provided in some other manner. Perfumes are generally described in U.S. Pat. No. 7,186,680 at column 10, line 56, to column 25, line 22. The perfume can be carried by a perfume carrier material. Examples of perfume carrier materials are described in U.S. Pat. No. 7,186,680, column 25, line 23, to column 31, line 7. Specific examples of perfume carrier materials may include cyclodextrin and zeolites.

The perfume can comprise a perfume raw material having a saturation vapor pressure greater than about 0.01 torr. Such a vapor pressure can be practical for having the perfume be sufficiently volatile to reach the consumers nose when the particles are in use. The composition can comprise a perfume raw material having a logP greater than about 3. Such a logP for the perfume can be practical for having acceptable deposition onto a laundry article, article of clothing. The perfume can comprise a perfume raw material having a saturation vapor pressure greater than about 0.01 torr and a logP greater than about 3. Such a perfume can be practical for providing sufficient volatility for the perfume to reach the consumers nose and sufficient deposition on to a laundry article, article of clothing, textile, or the like.

The saturation Vapor Pressure (VP) values are computed for each PRM in the perfume mixture being tested. The VP of an individual PRM is calculated using the VP Computational Model, version 14.02 (Linux) available from Advanced Chemistry Development Inc. (ACD/Labs) (Toronto, Canada) to provide the VP value at 25° C. expressed in units of torr. The ACD/Labs' Vapor Pressure model is part of the ACD/Labs model suite.

The value of the log of the Octanol/Water Partition Coefficient (logP) for the perfume is computed for each PRM in the perfume mixture being tested. The logP of an individual PRM is calculated using the Consensus logP Computational Model, version 14.02 (Linux) available from Advanced Chemistry Development Inc. (ACD/Labs) (Toronto, Canada) to provide the unitless logP value. The ACD/Labs' Consensus logP Computational Model is part of the ACD/Labs model suite.

If particles are employed and PEG is the solid matrix carrier, in addition to PEG, the particles can further comprise 0.1% to about 20% by weight perfume. The perfume can be unencapsulated perfume, encapsulated perfume, perfume provided by a perfume delivery technology, or a perfume provided in some other manner. The particles can comprise unencapsulated perfume and are essentially free of perfume carriers, such as a perfume microcapsules. The particles can comprise perfume carrier materials (and perfume contained therein).

The particles can comprise about 0.1% to about 20%, alternatively about 1% to about 15%, alternatively 2% to about 10%, alternatively combinations thereof and any whole percentages within any of the aforementioned ranges, of perfume by weight of the particles. The particles can comprise from about 0.1% by weight to about 6% by weight of the particles of perfume. The perfume can be unencapsulated perfume and or encapsulated perfume.

The particles can be free or substantially free of a perfume carrier. The particles may comprise about 0.1% to about 20%, alternatively about 1% to about 15%, alternatively 2% to about 10%, alternatively combinations thereof and any whole percentages within any of the aforementioned ranges, of unencapsulated perfume by weight of the particles.

The particles can comprise unencapsulated perfume and perfume microcapsules. Such levels of unencapsulated perfume can be appropriate for any of the particles disclosed herein that have unencapsulated perfume.

The particles can comprise unencapsulated perfume and perfume microcapsule but be free or essentially free of other perfume carriers. The particles, can comprise unencapsulated perfume and perfume microcapsules and be free of other perfume carriers.

The particles can comprise encapsulated perfume. Encapsulated perfume can be provided as plurality of perfume microcapsules. A perfume microcapsule is perfume oil enclosed within a shell. The shell can have an average shell thickness less than the maximum dimension of the perfume core. The perfume microcapsules can be friable perfume microcapsules. The perfume microcapsules can be moisture activated perfume microcapsules.

The perfume microcapsules can comprise a melamine/formaldehyde shell. Perfume microcapsules may be obtained from Appleton, Quest International, or International Flavor & Fragrances, or other suitable source. The perfume microcapsule shell can be coated with polymer to enhance the ability of the perfume microcapsule to adhere to fabric. This can be desirable if the particles are designed to be a fabric treatment composition. The perfume microcapsules can be those described in U.S. Patent Pub. 2008/0305982.

The particles can comprise about 0.1% to about 20%, alternatively about 1% to about 15%, alternatively about 2% to about 10%, alternatively about 0.1% to about 10%, alternatively about 0.4% to about 10%, alternatively combinations thereof and any whole percentages within any of the aforementioned ranges, of encapsulated perfume by weight of the particles.

The particles can comprise perfume microcapsules but be free of or essentially free of unencapsulated perfume. The particles may comprise about 0.1% to about 20%, alternatively about 1% to about 15%, alternatively about 0.1% to about 10%, alternatively about 0.4% to about 10%, alternatively combinations thereof and any tenths of percentages within any of the aforementioned ranges, of encapsulated perfume by weight of the particles.

The fluid pervious substrate 10 can carry between about 0.1 and 10 g of perfume on, within, or at least partially enclosed by, or enclosed by the substrate 10. The fluid pervious substrate 10 can carry about 1.5 g of perfume. The fluid pervious substrate 10 can carry the perfume in a solid matrix. For instance the solid matrix can be particles, a coating on the substrate, or a solid matrix in the interstitial spaces within the substrate 10.

Pouch

Figure 2:
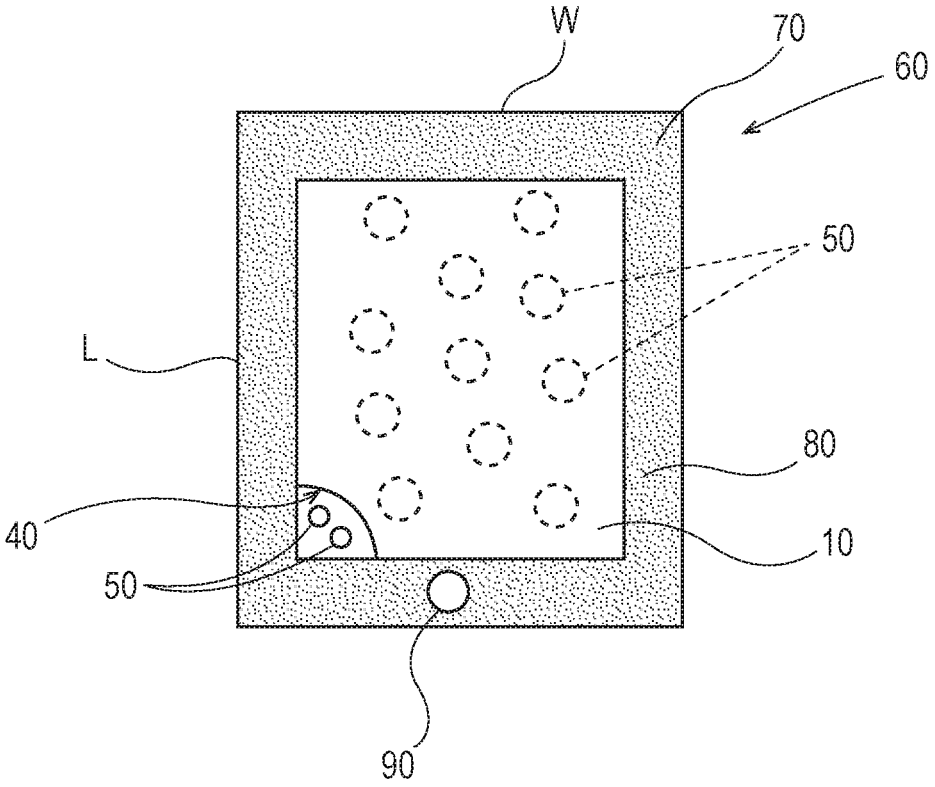
FIG. 2 is a pouch.

The substrate 10 can form at least part of a pouch 60 enclosing a chamber 40, as shown in FIG. 2. The pouch 60 can comprise a bond 70 that at least partially defines, or defines the chamber 40. The bond 70 can be a thermal bond, fusion bond, adhesive bond, ultrasonic bond, or any other bond suitable for joining an edge of a material to another edge. The chamber 40 can contain a plurality of water soluble particles 50 that carry the perfume, as described herein. The particles 50 can be any of the particles 50 disclosed herein carrying perfume as described herein.

The pouch 60 can have a length L and width W each between about 2 cm to about 20 cm and a thickness of between about 5 mm and about 5 cm. The pouch 60 can have length L of about 8 to about 10 cm and a width W of about 3 cm to about 8 cm.

Figure 3:
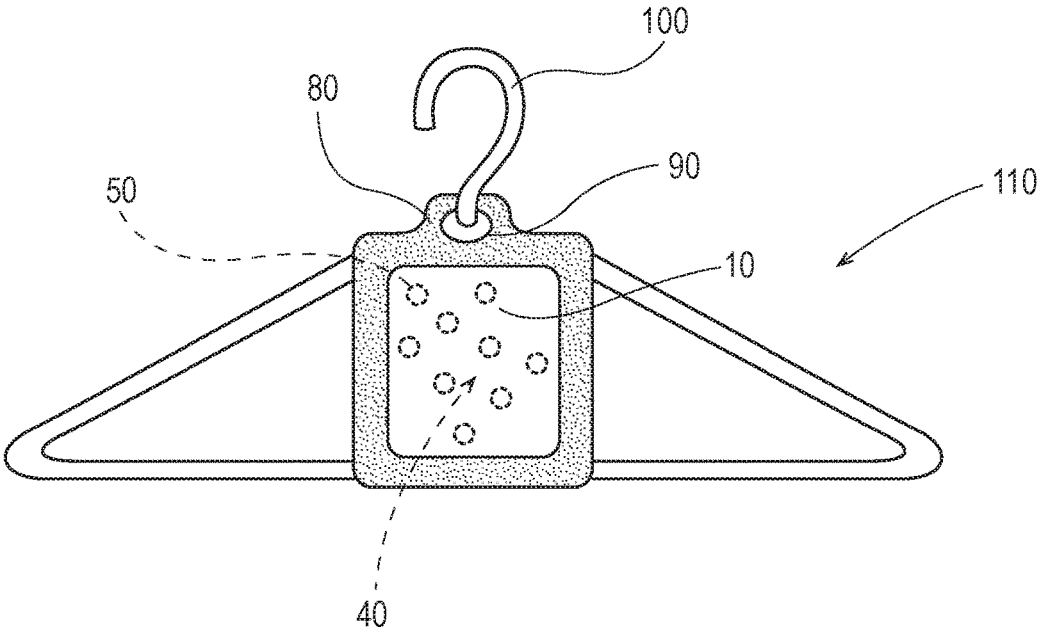
FIG. 3 is a hanger having a pouch hung thereon.

The pouch 60 can have an aperture 90 sized and dimensioned to fit onto the hook 100 of a clothing hanger 110, by way of non-limiting example as shown in FIG. 3.

The pouch 60 can have a tab 80 extending from the pouch 60. The tab 80 can be the bond 70. The tab 80 can be an extension from the bond 70. The tab 80 can be position so that the bond 70 or a portion of bond 70 is between the aperture 90 and the chamber 40. The tab 80 can have an aperture 90 passing through the tab 80. The aperture 90 can be sized and dimensioned to fit onto the hook 100 of a clothing hanger 110, as shown in FIG. 3. The aperture 90 can have an open area between about 2 $mm^2$ and about 10 $cm^2$. The aperture 90 can be of any desired shape such that it will fit on the hook of a clothing hanger. The aperture 90 can be a slot.

A construction in which the pouch 60 has an aperture 90 can be practical for associating a scent with an article while the article is hanging on a clothing hanger. For instance, a consumer might hang the pouch 60 on the hanger and then hang a clothing top such as a shirt or sweater on the hanger 110. When the article of clothing touches the pouch 60, scent can be transferred from the pouch 60 to the clothing article. When the consumer takes the clothing article off of the hanger 110, he can remove the pouch 60 from the hook 100 of the hanger 110 and place the pouch in his laundry container or pile. When the consumer later places the worn article of clothing into the container or pile, the pouch 60 is there to continue associate a scent with the soiled laundry article. A construction in which the pouch 60 has an aperture can be appealing to consumers since the pouch 60 has multiple purposes, multiple uses, and can be used at multiple junctures in time to refresh articles of clothing. The consumer has the freedom and flexibility to choose to use the pouch 60 in a manner most congruent to his or her needs.

Figure 4:
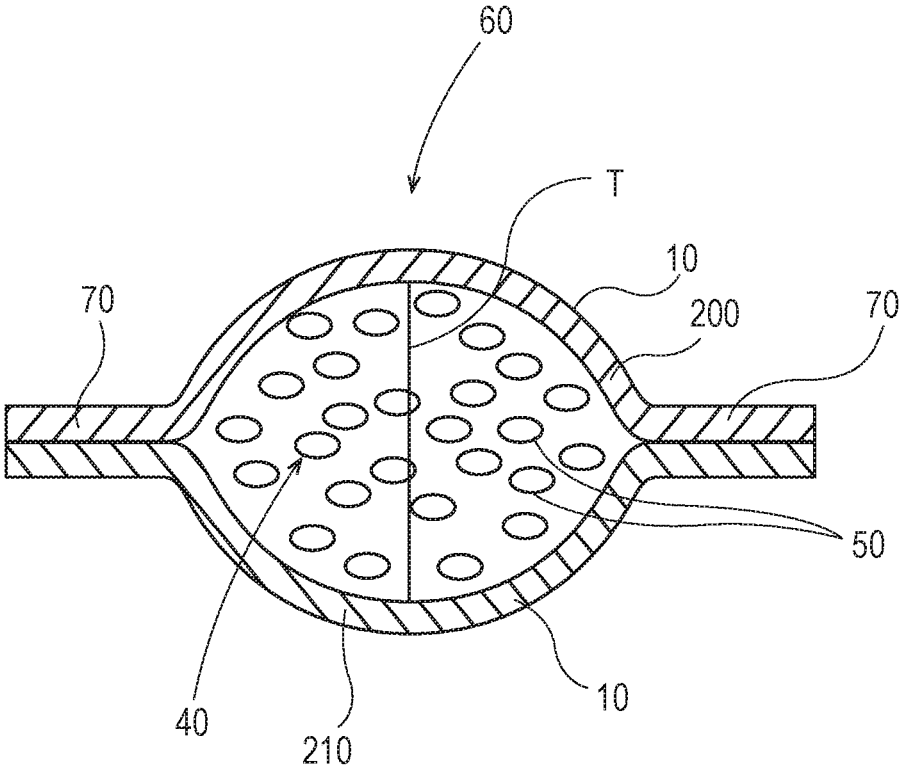
FIG. 4 is cross section view of a pouch.

The chamber 40 can contain a plurality of particles 50. The plurality of particles 50 can have a mass between about 1 g and about 50 g of particles 50. The plurality of particles 50 can have a mass between about 1 g and about 100 g of particles 50. A cross section of a pouch 60 is shown in FIG. 4. As shown in FIG. 4, the pouch 60 can have a thickness T. The thickness T of the pouch can be between about 0.1 mm to about 20 mm. The thickness T of the pouch can be from about 3 mm to about 10 mm.

The fluid pervious pouch can comprise a substrate 10 having an apparent opening size according to ASTM D4751-12 smaller than about 1000 μm. The fluid pervious pouch can comprise a substrate 10 having an apparent opening size according to ASTM D4751-12 smaller than about 500 μm. The fluid pervious pouch can comprise a substrate 10 having an apparent opening size according to ASTM D4751-12 smaller than about 200 μm. The fluid pervious pouch can comprise a substrate 10 having an apparent opening size according to ASTM D4751-12 smaller than about 100 μm. The fluid pervious pouch can comprise a substrate 10 having an apparent opening size according to ASTM D4751-12 between about 50 μm and about 1000 μm.

The fluid pervious pouch can comprise a substrate 10 having an apparent opening size according to ASTM D4751-12 between about 200 μm and about 800 μm. The fluid pervious pouch can comprise a substrate 10 having an apparent opening size according to ASTM D4751-12 between about 400 μm and about 600 μm.

This upper bound of apparent opening size can be practical to reduce the potential for the consumer's hands to contact the particles 50 when she employs the pouch 60 in the processes described herein. Depending on the constituents of the particles 50, the particles 50 may have a feel, texture, or chemical makeup that is not pleasing for the consumer to touch with her hand. Without being bound by theory, it is thought that by providing a substrate 10 having the aforesaid apparent opening size, the openings of such substrate 10 are small enough so as to reduce contact by the user with the particles 50 that are contained in the pouch 10 to a degree acceptable to the consumer. If larger openings are used, for instance an apparent opening size of 1 mm or greater, portions of the particles 50 may protrude through the openings of the substrate 10. This can be especially true if the particles 50 have a jagged shaped, irregularly shaped, or have sharply curved surfaces.

The pouch 60 can comprise a substrate 10 having a basis weight between about 1 gsm to about 100 gsm. In general, higher basis weight materials tend to have a greater thickness than lower basis weight materials, things such as material structure and constitution being equal. Higher basis weight substrates 10 can also be practical for reducing the potential for the consumer's hands to contact the particles 50. Without being bound by theory, this might be the case since a thicker substrate 10 increases the distance between the consumer's hand and the particles 50 contained in the pouch 60.

The substrate 10 can be fluid pervious. The substrate 10 can have an apparent opening size according to ASTM D4751-12 smaller than about 1000 μm and a basis weight between about 1 gsm to about 1000 gsm. The fluid pervious pouch can comprise a substrate 10 having an apparent opening size according to ASTM D4751-12 from about 50 μm to about 1000 μm. These ranges in these material properties are thought to provide for small enough openings and separation between the outside of the pouch 60 and the particles 50 contained therein to reduce to an acceptable level the potential for the consumer to contact the particles 50 with her hand.

A scented article can be used in the process as described herein. The scented article can comprise a fluid pervious pouch 60 enclosing a chamber 40 and a plurality of water soluble particles 50 contained in the chamber. The pouch 60 can comprise a substrate 10 having an apparent opening size according to ASTM D4751-12 smaller than about 1000 μm. The pouch 60 can comprise a substrate 10 having an apparent opening size according to ASTM D4751-12 from about 50 μm to about 1000 μm. The particles can comprise a carrier and a perfume. The particles 50 can have an individual mass between about 0.1 mg and about 10 g. The plurality of particles 50 can have a mass between about 5 g and about 100 g.

The pouch 60 can be used to associate a scent with a laundry article as described herein. For instance the pouch 60 can be placed in proximity to a partially saturated laundry article in a container or pile as described above to associate a scent with the partially saturated laundry article. The pouch 60, which comprises the substrate 10, and the partially saturated laundry article can be transferred from the container or pile to the washing machine and washed.

Optionally, the pouch 60 can be provided with an aperture 90. The aperture 90 can be sized and dimensioned to fit onto a clothing hanger. The consumer can provide a clothing hanger 110 and provide an article of clothing on the clothing hanger 110. The pouch 60, having the substrate 10, can be provided and engaged with the hanger 110 so that the substrate 10 is proximal the article of clothing.

Figure 5:
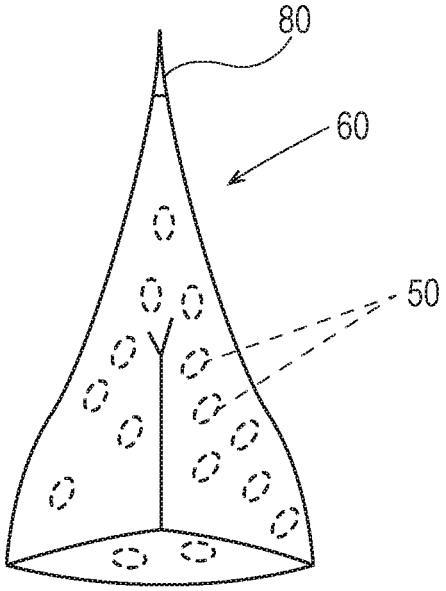
FIG. 5 is a gusseted pouch.
Figure 6:
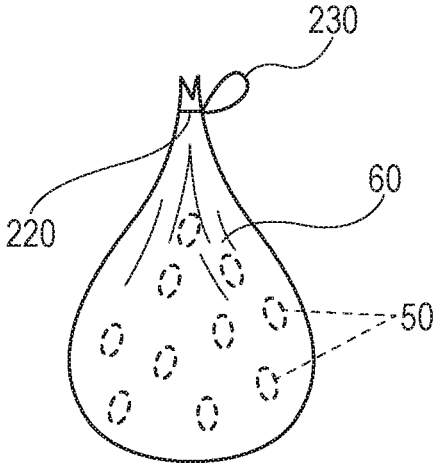
FIG. 6 is a drawn pouch.

The pouch 60 can also be practical for associating a scent with an article of clothing by providing an article of clothing worn on a body. The pouch 60, which comprises the substrate 10, can be provided. The pouch 60, which can carry a perfume in a solid matrix on, within, at least partially enclosed by, or enclosed by the pouch 60 can contacted with the clothing worn on the body. The pouch 60 can comprise a first sheet 200 and a second sheet 210, the second sheet 210 in facing relationship and joined to the first sheet 200 to form the pouch 60. The pouch 60 can comprise a single web of material folded upon itself and bonded at the sides to form a pouch 60 as shown in FIG. 5. The pouch 60 can be a gusseted pouch 60 formed from a single web of material having a bond 80 closing the pouch 60. The pouch 60 can be a gathered pouch 60 formed from a single web of material that is closed with a draw string 220 having a loop 230 as shown in FIG. 6.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for associating a scent with a laundry article comprising the steps of:

providing a fluid pervious substrate carrying a perfume on, within, or at least partially enclosed by said substrate;

placing said substrate in proximity to a partially saturated laundry article within a container or pile;

transferring said laundry article and said substrate from said container or said pile into a washing machine; and washing said laundry article together with said substrate;

wherein said substrate is water insoluble;

wherein said substrate is a fibrous web;

wherein said perfume comprises unencapsulated perfume;

wherein said substrate forms at least part of a pouch enclosing a chamber;

wherein said chamber contains a plurality of water soluble particles carrying said perfume;

wherein said pouch comprises a bond that at least partially defines said chamber;

wherein said pouch comprises an aperture passing through said pouch;

wherein said aperture is sized and dimensioned to fit onto a clothing hanger;

wherein said bond is positioned between said aperture and said chamber; and wherein said pouch comprises a tab extending from said pouch and said aperture passes through said tab.

2. The process according to claim 1, wherein said substrate is a nonwoven having a basis weight between about 1 gsm and about 1000 gsm.

3. The process according to claim 1, wherein said substrate is packaged within a hermetically sealed sleeve, said process further comprising a step of opening said sleeve and removing said substrate from said sleeve.

4. The process according to claim 1, wherein said perfume comprises encapsulated perfume.

5. The process according to claim 1, wherein said particles comprise a carrier selected from the group consisting of water soluble organic alkali metal salt, water soluble inorganic alkaline earth metal salt, water soluble organic alkaline earth metal salt, water soluble carbohydrate, water soluble silicate, water soluble urea, starch, clay, water insoluble silicate, citric acid, carboxymethyl cellulose, fatty acid, fatty alcohol, glyceryl diester of hydrogenated tallow, glycerol, polyvinyl alcohol, polyethylene glycol, and combinations thereof.

6. The process according to claim 5, wherein said carrier is polyethylene glycol having a weight average molecular weight between from about 2000 to about 13000.

7. The process according to claim 1, further comprising the step of dispensing a detergent composition into said washing machine.

8. The process according to claim 1, wherein said substrate is at least partially coated with a carrier comprising said perfume.

9. The process according to claim 1, wherein said perfume is loaded on a carrier selected from the group consisting of water soluble organic alkali metal salt, water soluble inorganic alkaline earth metal salt, water soluble organic alkaline earth metal salt, water soluble carbohydrate, water soluble silicate, water soluble urea, starch, clay, water insoluble silicate, citric acid carboxymethyl cellulose, fatty acid, fatty alcohol, glyceryl diester of hydrogenated tallow, glycerol, polyethylene glycol, and combinations thereof.

10. The process according to claim 1, wherein said substrate is placed in proximity to said partially saturated laundry article within a container, wherein said container is selected from the group consisting of a laundry hamper, a laundry basket, a laundry bag, a duffle bag, a gym bag, a suitcase, a back pack, and a drawer.

11. The process according to claim 1, wherein said substrate has an apparent opening size according to ASTM D4751-12 smaller than about 1000 μm.

12. The process according to claim 1, wherein said substrate forms at least part of a pouch enclosing a chamber, wherein said chamber contains a plurality of water soluble particles carrying said perfume, wherein said plurality of particles has a mass between about 1 mg and about 100 g.

13. The process according to claim 1, wherein said perfume comprises a perfume raw material having a saturation vapor pressure greater than about 0.01 torr.

14. The process according to claim 1, wherein said perfume comprises a perfume raw material having a logP greater than about 3.

* * * * *